US005122047A

United States Patent [19]

Bauckhage et al.

[11] Patent Number: 5,122,047

[45] Date of Patent: Jun. 16, 1992

[54] APPARATUS FOR PULVERIZING AT LEAST A JET OF A PULVERIZING FLUID, PREFERABLY A MOLTEN METAL

[75] Inventors: Klaus Bauckhage; Peter Schreckenberg; Hermann Vetters, all of Bremen, Fed. Rep. of Germany

[73] Assignee: Branson Ultraschall Niederlassung der Emerson Technologies GmbH & Co., Fed. Rep. of Germany

[21] Appl. No.: 618,678

[22] Filed: Nov. 27, 1990

[30] Foreign Application Priority Data

Nov. 27, 1989 [DE] Fed. Rep. of Germany ..... 3939178

[51] Int. Cl.[5] ..... B28B 17/00

[52] U.S. Cl. ..... 425/174.2; 164/501; 241/1; 241/301; 266/200; 266/202; 239/102.1

[58] Field of Search ..... 241/1, 301; 164/501; 266/200, 202, 48; 239/85, 102.1; 264/9, 12, 23; 425/7, 174.2

[56] References Cited

U.S. PATENT DOCUMENTS 3,274,642 9/1966 Cramer ..... 425/174.2
4,473,185 9/1984 Peterson et al. .
4,981,425 1/1991 Lierke et al. ..... 425/174.2

FOREIGN PATENT DOCUMENTS 0308600 3/1989 European Pat. Off. .
0308933 3/1989 European Pat. Off. .
1958610 9/1978 Fed. Rep. of Germany .
2749859 5/1979 Fed. Rep. of Germany .
3108481A1 2/1982 Fed. Rep. of Germany .
3713253A1 2/1988 Fed. Rep. of Germany .
3735787A1 3/1989 Fed. Rep. of Germany .
3407059C2 3/1990 Fed. Rep. of Germany .

*Primary Examiner*—Mark Rosenbaum
*Assistant Examiner*—Frances Chin
*Attorney, Agent, or Firm*—Harness, Dickey & Pierce

[57] ABSTRACT

The invention relates to an apparatus for pulverizing at least a jet of a liquid or solid material in a standing ultrasonic field which is generated between at least a pair of ultrasonic devices. To increase the pulverizing capacity a plurality of pulverizing fluid jets and in addition supplementary fluid jets, for example a gas is introduced through separate nozzles at each nodal pressure area of the standing ultrasonic wave. In addition the pulverizing capacity is further increased by providing special horn shapes of the ultrasonic devices.

12 Claims, 3 Drawing Sheets

APPARATUS FOR PULVERIZING AT LEAST A JET OF A PULVERIZING FLUID, PREFERABLY A MOLTEN METAL

BACKGROUND OF THE INVENTION

The present invention refers to an apparatus for pulverizing at least a jet of a liquid or solid material, preferably molten metal.

According to a prior art device (European Al 0308933) a pair of ultrasonic generators are located opposite each other in a throttle section of a nozzle through which an inert or reaction gas enters the ultrasonic field created between the ultrasonic generators. The gas stream facilitates the pulverizing process and allows a well defined transfer of particles out from the pulverizing area.

According to another known device (German C2 28 42 232) for pulverizing coal particles used in a heating application the combustion air may be radially blown through slot or ring nozzles in the pressure loops or nodal areas of a standing wave of an ultrasonic field which is generated between an ultrasonic device and a reflector.

It is an object of the present invention to improve an ultrasonic device of the type referred to above in order to substantially increase the pulverizing capacity. A further object is to improve the control of the pulverizing process.

SUMMARY OF THE INVENTION

According to the present invention, an apparatus for pulverizing at least a jet of a pulverizing fluid, preferably molten metal, has at least a pair of ultrasonic devices which are provided opposite to each other on a common axis at a predetermined distance, to generate a standing ultrasonic field therebetween including pressure nodal areas in which said pulverizing fluid is pulverized by ultrasonic energy and in the presence of a supplementary fluid, wherein a jet of pulverizing fluid and at least a jet of supplementary fluid are introduced in said pressure nodal areas through separate nozzles each.

According to the present invention the supplementary fluid which is gaseous in most applications is introduced through nozzles aiming at the nodal pressure areas of the standing ultrasonic wave in addition to the fluid jet of the medium to be pulverized which is liquid in most applications. The capacity of supplementary fluid through the nozzles is individually adjustable with respect to the pulverizing fluid. Preferrably a plurality of pulverizing and supplementary fluid jets are introduced. The volume of pulverizing fluid should be limited by a maximum level as the jet may otherwise break through the pulverizing area resulting in a reduced pulverizing capacity.

However, by introducing a plurality of supplementary fluid jets in addition to the pulverizing fluid jet at the pulverizing areas in the pressure nodals both the pulverizing and fluid mass capacity is substantially increased. This is due to a local rise of the gas density (impact pressure) within the pulverizing area of the nodal points and due to the increase of turbulances in the pulverizing areas caused by the well defined introduction of supplementary fluid mass volume. By aiming and locally limiting both the beams of pulverizing and supplementary fluids a two-phase-pulverization is obtained. Within the pulverizing area the supporting supplementary gas causes a pulse transfer in addition to the ultrasonic energy resulting in a substantial power increase of the process. It was further observed that the size of the droplets is shifted towards smaller droplets. Still further the control of the process by modifying the supplementary gas stream is improved. There is an increased cooling effect and a higher cooling velocity within the pulveriziation area and the transport of particles therefrom is improved.

It should be understood that the pulveriziation fluids include liquids, in particular molten materials and solid materials such as minerals, powders or foams. The supplementary fluids include gases, vapours, mist, liquid, powder and the like.

BRIEF DESCRIPTION OF THE DRAWINGS

Other advantages and features of the invention will appear from the following description of a number of non-limiting embodiments with reference to the figures which show.

DESCRIPTION OF THE PREFERRED EMBODIMENTS

Figure 1:
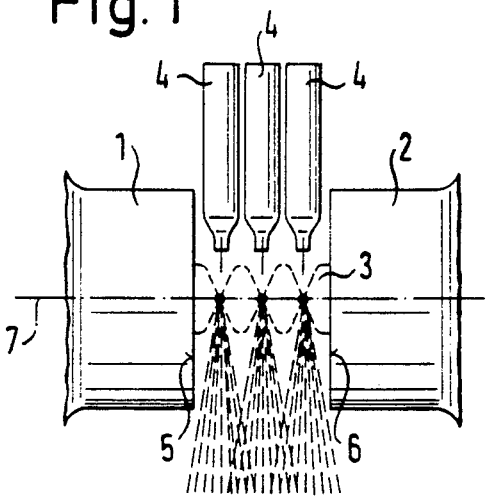
FIG. 1 a side view of a first embodiment incorporating three crucibles supplying molten metal to three pressure nodal points.

FIG. 1 shows an apparatus which was earlier disclosed in European A-0308 933 in which an ultrasonic standing wave 3 comprising pressure nodals and pressure loops is generated between a pair of horns 1 and 2 being part of ultrasonic devices not shown in FIG. 1. The outlets of crucibles 4 are directed towards the nodal points to release one or more molten material jets which are pulverized in the ultrasonic field in the presence of a gas entering the pulverizing area between the horn surfaces 5 and 6.

Figure 2:
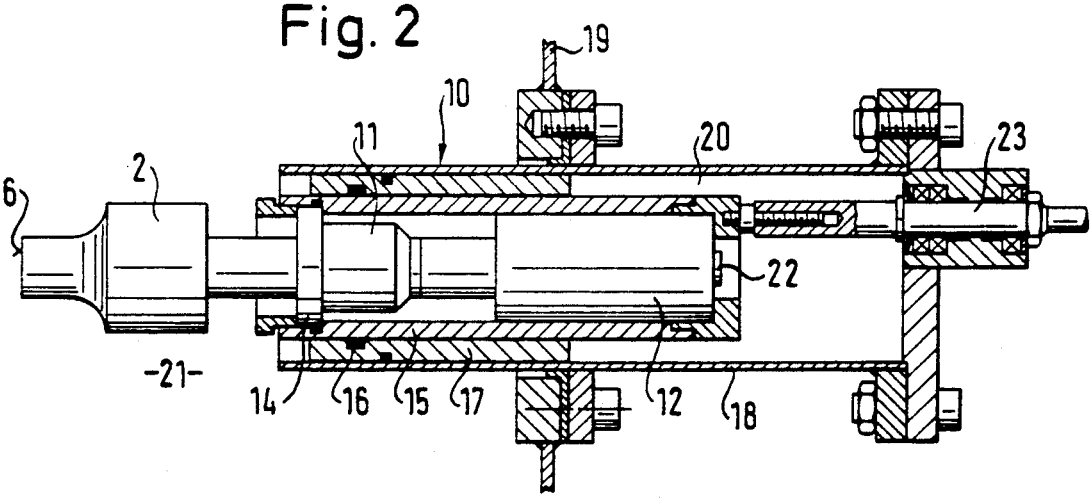
FIG. 2 a section through an embodiment of an ultrasonic device.

The horn 2 is part of an ultrasonic device which is shown in FIG. 2 and which has a booster 11 and a converter 12. A casing 15 is pressure tight connected at a nodal point 14 of the booster 11. The casing 15 encloses the converter 12 and the booster 11. The casing 15 is connected by means of a sleeve 17 having seals 16 to an outer housing 18 which defines a cartridge mounted in a wall 19 separating the outer atmosphere 20 from the pressure chamber 21 in which the pulverizing process takes place. An electrical cable 22 is connected to the converter 12 by means of the housing 18. The casing 15 is axially adjustable by means of an adjusting device 23.

Figure 3:
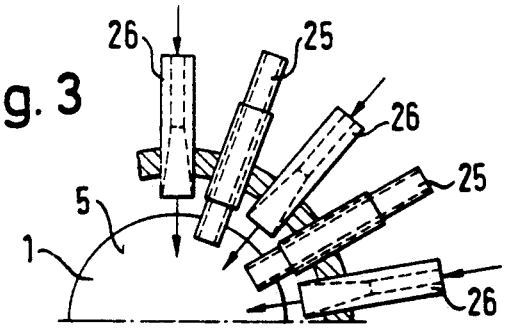
FIG. 3 a device including a number of separate nozzles to introduce pulverizing and supplementary fluid at nodal pressure areas.
Figure 5:
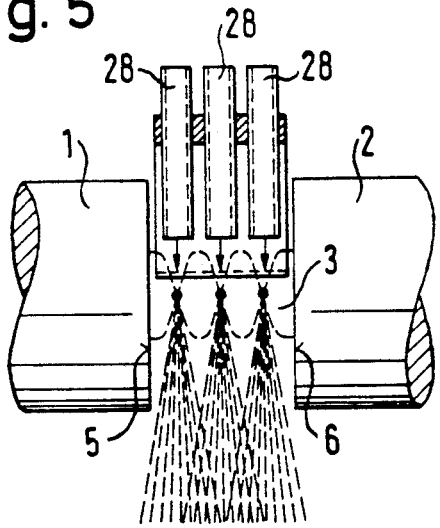
FIG. 5 a side view of FIG. 4.

FIG. 3 shows a front view of the surface 5 of the horn 1. Adjacent the pulverizing fluid nozzles 25 there are individual supplementary fluid nozzles 26 which are connected to pressure fluid sources not shown. Both the nozzles 25 and 26 are radially directed and peripherally spaced. Through the nozzles 25 and 26 the fluid jets are aimed at the longitudinal axis 7 of the ultrasonic device. Preferably the jets enter the nodal pressure areas of the ultrasonic field as shown in FIG. 5. According to FIG. 3 the nozzles alternate so that a supplementary fluid jet originates from nozzle 26 adjacent a pulverizing fluid jet each originating from a nozzle 25. The special combination of nozzles which may continue around the periphery of the horn results in a highly increased fluid capacity and pulverizing output.

Figure 4:
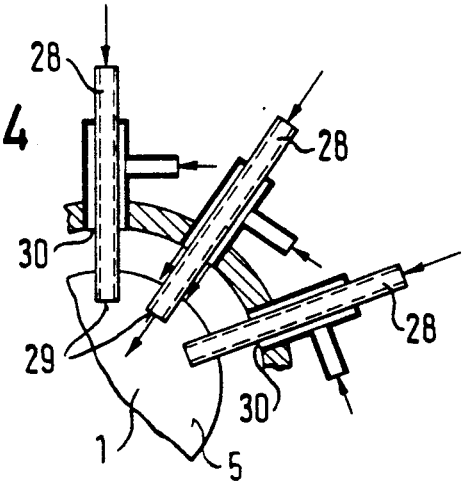
FIG. 4 a device including a plurality of annular nozzles for introducing pulverizing and supplementary fluid at a nodal pressure area.

FIG. 4 shows annular nozzles 28 from which central opening 29 the pulverizing fluid jet and from an annular opening 30 the supplementary fluid jet originates which annular opening encloses the central opening. All the nozzles are aimed at a nodal pressure point each in the standing wave.

FIG. 5 shows a number of separate or annular nozzles 25, 26, 28 according to FIG. 3 or 4 to introduce pulverizing and supplementary fluid jets each aimed at an individual nodal pressure area of the standing wave. A plurality of nozzles 25, 26 and 28 is provided for each nodal pressure area.

Figure 6:
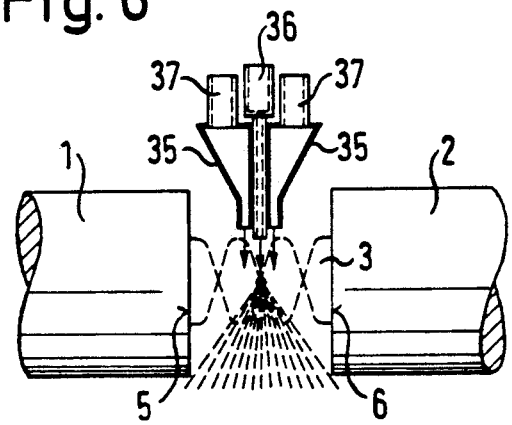
FIG. 6 a side view of a flat nozzle in a nodal pressure area.

FIG. 6 shows a flat nozzle 35 including conduits 36 for the pulverizing fluid and conduits 37 for supplementary gas. The supplementary gas jet is supplied at both sides of the centrally originating pulverizing gas jet and is aimed at the pulverizing area of the ultrasonic wave.

Figure 7:
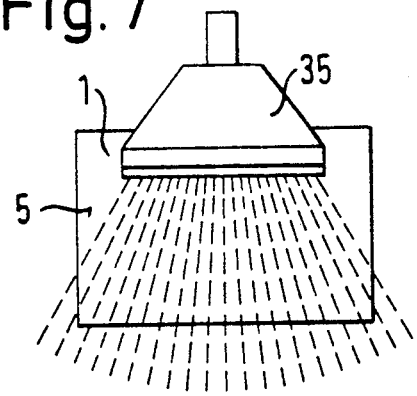
FIG. 7 a front view of the nozzle shown in FIG. 6.
Figure 8:
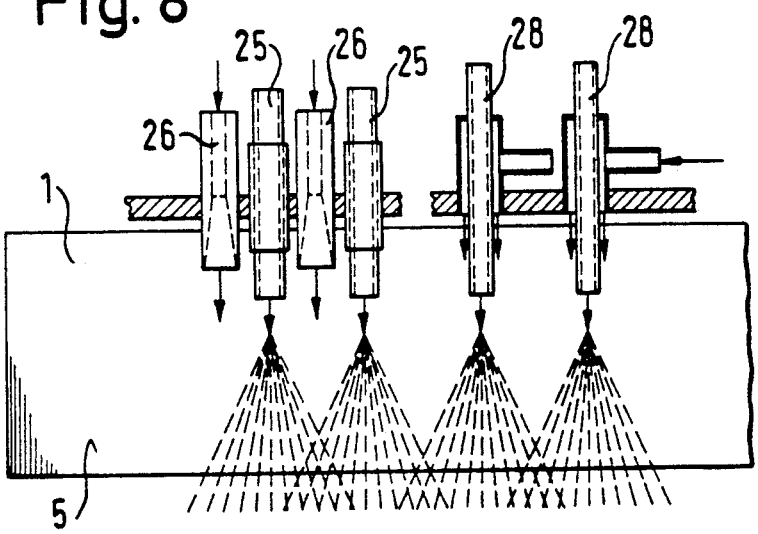
FIG. 8 a front view of a nozzle device according to FIG. 3 or 4 for a rectangular ultrasonic horn.

FIG. 7 shows the front surface 5 of a rectangular horn 1 which is preferrably used with a flat nozzle 35. This type of large area horn increases the pulverizing capacity. The same is true for the embodiment shown in FIG. 8. This embodiment comprising a large rectangular horn 1 and a number of nozzles 25, 26 or, respectively annular nozzles 28 arranged side by side in rows which nozzles again are provided in the planes of the nodal pressure areas.

All embodiments may be accomodated in a pressure container in which the gas jets are subjected to a compression such that the energy transfer is increased in the compressed medium.

Figure 9:
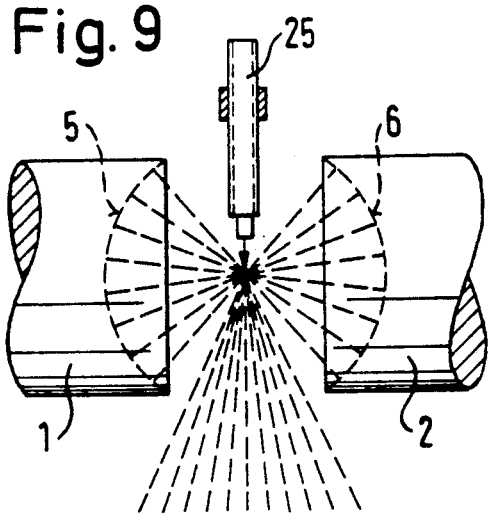
FIG. 9 a side view showing concave horn shapes.

FIG. 9 shows a further embodiment to improve the pulverizing capacity. The surfaces 5 and 6 of the horn are shaped concave so that the energy focuses in the node of the ultrasonic standing wave to increase the sonic alternating pressure. Furthermore the horn surfaces may be coated to lessen the wettability. For example a coating of boron nitrite, titanium nitrite may be evaporated or the surfaces may be coated by chromium or an anodizing process.

What is claimed is:

1. An apparatus for pulverizing at last a jet of a pulverizing fluid, preferably a molten metal, comprising: a nozzle for introducing said jet of said pulverizing fluid; a nozzle for introducing a jet of a supplementary fluid; at least a pair of ultrasonic devices provided opposite to each other on a common axis at a predetermined distance to generate a standing ultrasonic field therebetween, including nodal pressure areas in which said pulverizing fluid is pulverized by ultrasonic energy and in the presence of said supplementary fluid; wherein at least said jet of said pulverizing fluid and at least said jet of said supplementary fluid are each introduced at said nodal pressure areas through said respective introducing nozzles.

2. The apparatus of claim 1 wherein said pulverizing fluid is liquid and the supplementary fluid is a gaseous.

3. The apparatus of claim 1, wherein the fluid mass capacities are individually adjustable and controllable through said nozzles.

4. The apparatus of claim 1, wherein said pulverizing and supplementary fluid jets are introduced through individual nozzles.

5. The apparatus of claim 4, wherein said nozzles are provided with a central opening out of which said pulverizing fluid jet originates and also with an annular opening, located outward of said central opening, out of which said supplementary fluid jet originates.

6. The apparatus of claim 1, wherein flat nozzles are provided from which the complementary fluid originates at either side of the pulverizing fluid.

7. The apparatus of claim 1, wherein the nozzles for both fluid jets are provided offset with respect to each other around the periphery.

8. The apparatus of claim 1, wherein said nozzles are provided side by side in rows in alignment with a plurality of nodal points which nozzles are arranged beyond each other and rotatably offset to each other.

9. An apparatus for pulverizing a jet of liquid material, preferably a molten metal, comprising: a nozzle device for introducing said liquid material to be pulverized; a nozzle device for introducing a jet of a supplementary fluid; at least a pair of ultrasonic devices arranged opposite to each other on a common axis to generate a standing ultrasonic wave therebetween, including nodal pressure points in which said liquid material to be pulverized is pulverized by means of ultrasonic energy and in presence of said supplementary fluid entering said ultrasonic filed through said nozzle device under pressure; and wherein a plurality of said nozzle devices are arranged in a side by side relationship with respect to one another; wherein said plurality of said nozzle devices are directed towards nodal pressure points of said standing ultrasonic wave; and wherein said plurality of said nozzle devices are located between opposing horn surfaces of said ultrasonic devices.

10. The apparatus of claim 9, wherein said surfaces are shaped concave.

11. The apparatus of claim 9, wherein said surfaces are coated.

12. The apparatus of claim 9, further comprising a plurality of parallel planes, wherein each individual plane thereof passes through one of said nodal pressure points of said standing ultrasonic wave between said opposing horn surfaces of said pair of ultrasonic devices; and wherein several of said nozzle devices are positioned within each plane about said common axis of said pair of ultrasonic devices; and wherein each of said several nozzle devices positioned within each plane are spatially offset from one another.

* * * * *